United States Patent [19]

Houssian

[11] Patent Number: 4,941,427

[45] Date of Patent: Jul. 17, 1990

[54] SPRAY BOOTH

[75] Inventor: Vazgen J. Houssian, Union City, N.J.

[73] Assignee: Esselte Pendaflex Corporation, Garden City, N.Y.

[21] Appl. No.: 246,990

[22] Filed: Sep. 20, 1988

[30] Foreign Application Priority Data

Sep. 24, 1987 [GB] United Kingdom ..... 8722517

[51] Int. Cl.[5] ..... B05B 15/12

[52] U.S. Cl. ..... 118/326; 118/DIG. 7; 98/115.2; 229/113

[58] Field of Search ..... 118/326, DIG. 7; 98/115.2; 229/49, 113, 103, 114

[56] References Cited

U.S. PATENT DOCUMENTS

| | | | |
|---|---|---|---|
| 203,899 | 5/1878 | Dunn | 229/114 |
| 265,590 | 10/1882 | Fiske | 229/114 |
| 926,758 | 7/1909 | Miller | 229/114 |
| 1,811,074 | 6/1931 | Butler | 229/113 |
| 1,950,111 | 3/1934 | Heim | 229/114 |
| 2,134,927 | 11/1938 | Peppiatt | 229/113 |
| 2,702,154 | 2/1955 | Linson | 229/114 |
| 2,875,943 | 3/1959 | Cooper | 229/114 |
| 3,100,074 | 8/1963 | Beck | 229/113 |
| 3,343,660 | 9/1967 | Bailey | 229/114 |
| 3,547,336 | 12/1970 | Jacke | 229/114 |
| 3,695,226 | 10/1972 | Wanner et al. | 118/326 |
| 4,192,462 | 3/1980 | Erickson | 239/288 |
| 4,362,266 | 12/1982 | Webinger | 229/114 |
| 4,760,951 | 8/1988 | MacGregor | 118/326 |

FOREIGN PATENT DOCUMENTS

| | | | |
|---|---|---|---|
| 2031081 | 2/1971 | Fed. Rep. of Germany . | |
| 427845 | 5/1935 | United Kingdom | 229/113 |
| 815804 | 7/1959 | United Kingdom . | |

*Primary Examiner*—James C. Housel
*Attorney, Agent, or Firm*—Darby & Darby

[57] ABSTRACT

A spray booth (1) for use when spraying artwork is of pyramidal shape, and foldable for storage. An aerosol spray may be applied to the artwork via an aperture (6) at the apex of the pyramid which can then be closed by a flap (7) while the aerosol settles.

9 Claims, 1 Drawing Sheet

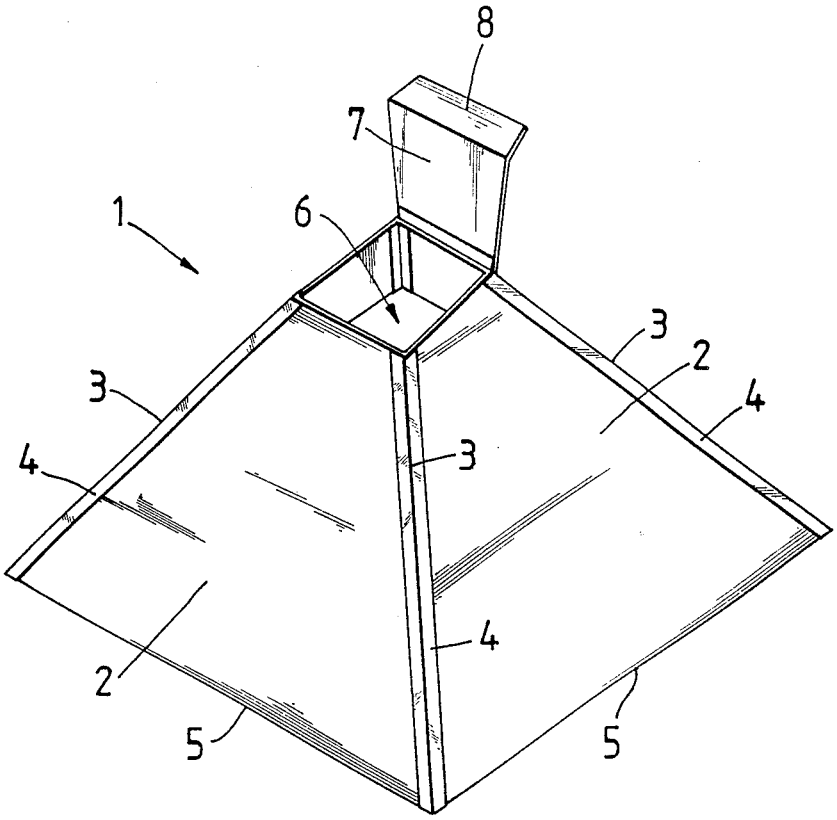
8
7
1
6
3
2
4
3
4
3
4
2
5
5

SPRAY BOOTH

FIELD OF THE INVENTION

This invention relates to spray booths and in particular to spray booths for graphic art studio work.

BACKGROUND OF THE INVENTION

The creation of much art work in graphic art studios involves the application of various materials to the artwork. Aerosol sprays are frequently used for applying materials such as adhesives and paints to achieve an overall desired surface coverage of the artwork.

However, many aerosol spray materials when used, create fumes which undesirably pervade the art studio unless confined and overspray which needs to be cleaned up or which requires the use of a disposable surface on which to work, e.g. a supply of newspaper. Spray booths for preventing the spread of aerosol spray fumes and confining overspray are known but they can be large and expensive, often taking up precious space in frequently small studios.

GENERAL DESCRIPTION OF THE INVENTION

This invention provides a spray booth comprising a collapsible hollow pyramid, the pyramid having a truncated vertex defining an opening, and closure means for the opening, the pyramid being collapsible by flexure of flexible joints between its faces to a substantially flat form for storage.

This is an economical and effective spray booth for confining fumes and overspray from aerosol spraying of material.

Artwork to which material in an aerosol spray is to be applied can be laid on a flat surface, preferably covered by a disposable sheet e.g. of newspaper, and a spray booth according to this invention may then placed over the artwork. Alternatively, if the booth has a base hinged to one side of the pyramid, the artwork is laid on the base and the pyramid swung over to cover it. The artwork is then sprayed with material through the opening of the truncated vertex. The confinement provided by the walls of the pyramid prevents overspray outside the area of the base of the booth. Once spraying is completed, the opening can be closed, and the fumes thus confined within the hollow interior of the pyramid until the residual spray materials have subsided inside the booth and on the artwork.

When the artwork is uncovered it is found that if is completely and uniformly covered with the material which has been sprayed on. It is believed that the circulation of the atmosphere within the pyramid during spraying assists in promoting even distribution of the aerosol and accordingly even coating of the artwork, which may be achieved even if the spraying action of the user is itself not very even.

The spray booth can then be collapsed by folding with flexure of flexible joints between its faces, for stowage elsewhere. If the pyramid has no base, the artwork is lifted from the disposable sheet, and the latter discarded.

The flexible joints may be provided in any suitable manner, for example by fold lines if the material from which the spray booth is made is suitable, or by the provision of hinges. Hinges may be made from adhesive tape with a flexible plastics backing, e.g. of polyethylene terephthalate tape.

Preferably the pyramid has an even number of faces for ease of folding flat for storage or for shipping. However, if an uneven number of faces is used, then in order to obtain a flattened shape when collapsed, two of the faces of the pyramid can be so chosen as to be half the size of other faces such that the two can form one single face when lain flat alongside one another, their common edge becoming flattened rather than folded. Alternatively, faces can be made detachable one from another for ease of folding. Burr fastener strips can be used for such a purpose. The most convenient shape for the pyramid for general use is a four-sided square section pyramid.

The opening in the top of the pyramid created by the truncation of the vertex may be closed and sealed by various means, for example, by a simple flap, or by a cap. The flap or cap may be held in place by gravity, or more positively held on to the top of the pyramid e.g. by a magnetic locking strip or burr fastener strip. In order to facilitate satisfactory spraying through the aperture from aerosol dispensing canisters, it is preferred that the plane of truncation of the vertex of the pyramid is non-horizontal e.g. inclined 5° to 20° to the horizontal. This enables the canister to be held with its axis inclined to the horizontal while spraying, so avoiding mis-spraying due to the dip tube end becoming exposed.

The faces of the spray booth and the closure flap or lid for the opening may be made from any suitable material e.g. cardboard, metal, wood or plastics. A preferred material to use is scored cardboard, with an integral flap for the upper opening.

BRIEF DESCRIPTION OF THE DRAWING

The drawing shows a perspective view of a spray booth according to the invention.

SPECIFIC DESCRIPTION OF THE ILLUSTRATED EMBODIMENT

One embodiment of the invention will now be described by way of example with reference to the accompanying drawing.

The drawing shows a spray booth 1 in its erected position. It has four indicated faces generally designated 2. Each face is joined to the next at their common edges 3 by polyethylene terephthalate film adhesive tape 4. The lower edges 5 of the booth are straight so as to form a closed chamber when it is laid on top of a flat surface, e.g. a table or floor.

As shown, the base of the booth is a square. The upper opening 6 at the truncated apex of the pyramid is inclined as shown, the shape formed by its edges being a trapezium.

A trapezoidal flap 7 hinged to the shortest sides of opening 6 is used to cover the upper opening 6 once spraying is completed. Flap 7 has a tab 8, and is sized to enable it to be pushed just inside upper opening 6. The booth is collapsible by folding the faces together with flexure of the hinges formed by the polyethylene terephthalate film taped edges 3. It can then be stored flat elsewhere in the studio.

The size of the booth is such that its base area is greater than the area of the artwork to be treated.

In use, the four-sided pyramid is erected and placed over artwork to be sprayed. The artist applies his material from an aerosol sprayed through the upper opening 6 in desired quantities. He then closes the upper opening 6 with the flap 7 to confine the aerosol within the booth, leaving tap 8 projecting. The aerosol gradually subsides and settles inside the pyramid on the artwork. The booth can then be removed, collapsed by folding, after tab 8 has been pulled to release flap 7, and stowed away.

I claim:

1. A spray booth, comprising a collapsible hollow pyramid having a plurality of faces, a base, and a truncated vertex defining an opening, closure means for closing said opening, means for collapsing said pyramid into a substantially flat form, said collapsing means including flexible joints between said faces, said truncated vertex having sides which define said opening, said sides defining a plane which is inclined relative to a plane of the base of the pyramid.

2. The spray booth of claim 1, wherein the closure means is a flap.

3. The spray booth of claim 1, wherein the pyramid has four faces.

4. The spray booth of claim 1, wherein an angle of inclination of the plane of the sides of the opening at the vertex is 5° to 20° to the plane of the base of the pyramid.

5. The spray booth of claim 1 wherein the flexible joints are hinges of adhesive tape with a polyethylene terephthalate backing.

6. The spray booth of claim 1 wherein the flexible joints are fold lines in the material of which the booth is made.

7. The spray booth according to claim 1 wherein one joint between two adjacent faces is formed by a burr fastener strip.

8. The spray booth of claim 1, wherein said base is open.

9. The spray booth of claim 1, wherein said base is hinged to at most one of said faces.

* * * * *